US009433276B2

(12) United States Patent
McNamara et al.

(10) Patent No.: US 9,433,276 B2
(45) Date of Patent: Sep. 6, 2016

(54) COSMETIC CONTAINER

(71) Applicant: TOLY MANAGEMENT LIMITED, Zejtun (MT)

(72) Inventors: Brian McNamara, Mosta (MT); Mario Delia, Zabbar (MT); James Attard Kingswell, Attard (MT)

(73) Assignee: Toly Management Limited (MT)

( * ) Notice: Subject to any disclaimer, the term of this patent is extended or adjusted under 35 U.S.C. 154(b) by 126 days.

(21) Appl. No.: 14/204,308

(22) Filed: Mar. 11, 2014

(65) Prior Publication Data

US 2014/0270891 A1 Sep. 18, 2014

(30) Foreign Application Priority Data

Mar. 12, 2013 (GB) ..... 1304416.9
Mar. 4, 2014 (GB) ..... 1403781.6

(51) Int. Cl.
*A45D 40/06* (2006.01)
*A45D 40/00* (2006.01)

(52) U.S. Cl.
CPC ..... *A45D 40/06* (2013.01); *A45D 2040/0056* (2013.01)

(58) Field of Classification Search
CPC ..... A45D 40/04; A45D 40/06; A45D 40/14; A45D 40/16; A45D 2040/204
USPC ..... 403/348
See application file for complete search history.

(56) References Cited

U.S. PATENT DOCUMENTS 2,698,085 A 12/1954 Schall
6,108,944 A * 8/2000 Savoie ..... A43C 15/161 403/348
2007/0147948 A1* 6/2007 Murakoshi ..... A45D 40/04 401/175

FOREIGN PATENT DOCUMENTS

GB 598838 2/1948
KR 101231622 2/2013

OTHER PUBLICATIONS

Search Report in corresponding United Kingdom Application No. GB1304416.9 dated Jul. 29, 2013.

* cited by examiner

*Primary Examiner* — Mark A Laurenzi
*Assistant Examiner* — Bradley Oliver
(74) *Attorney, Agent, or Firm* — Barnes & Thornburg LLP

(57) ABSTRACT

A cosmetic container for housing a cosmetic product applicator is presented. The cosmetic container comprises: a tubular housing within which a cosmetic product applicator can be inserted; and a platform positioned within the tubular housing, the platform being movable along the longitudinal axis of the housing. The platform comprises an interlock arrangement adapted to releasably engage an interface section of a cosmetic product applicator.

8 Claims, 8 Drawing Sheets

COSMETIC CONTAINER

CROSS REFERENCE TO RELATED APPLICATIONS

This patent application claims priority to United Kingdom patent application no. 1304416.9, filed Mar. 12, 2013, and United Kingdom patent application no. 1403781.6, filed Mar. 4, 2014. The disclosures set forth in the referenced applications are incorporated herein by reference in their entireties.

FIELD OF INVENTION

The present invention relates to the field of cosmetic containers, and more particularly to cosmetic containers having a tubular housing within which a cosmetic product applicator may be inserted.

BACKGROUND TO THE INVENTION

Conventional cosmetic containers comprise: a cosmetic product applicator including a base carrying a stick of cosmetic product (such as lipstick, lip-gloss, foundation, eye shadow, concealer or blusher for example); and a tubular housing (of circular or other section) forming a cap which cooperates with the base to enclose and protect the stick of cosmetic product when the user does not wish to use it.

Various structures have been proposed for cosmetic containers of the above kind which cater for different types of cosmetic product applicators and/or bases. The aforementioned conventional cosmetic containers are widely used and have resulted in features which may be viewed as commonplace and standard.

SUMMARY OF THE INVENTION

According to a first aspect of the invention, there is provided a cosmetic container for housing a cosmetic product applicator comprising: a tubular housing within which a cosmetic prod applicator can be inserted; and a platform positioned within the tubular housing, the platform being movable along the longitudinal axis of the housing, wherein the platform comprises an interlock arrangement adapted to releasably engage an interface section of a cosmetic product applicator, and wherein the interlock arrangement is rotatable relative to the interface section of a cosmetic product applicator to move between a locked configuration, in which the cosmetic product applicator is secured to the platform to prevent its removal from the cosmetic container, and a release configuration, in which the cosmetic product applicator is releasable from the platform so as to permit its removal from the cosmetic container.

The interlock arrangement may be rotated relative to the interface section of a cosmetic product applicator to move between a locked configuration and a release configuration. Also, the interlock arrangement may be adapted to move between a locked configuration and a release configuration half a turn or less (i.e. less than 180° of rotation relative to the interface section of a cosmetic product applicator), and preferably by quarter of a turn (i.e. 90° of rotation relative to the interface section of a cosmetic applicator). Embodiments may therefore employ a "twist-to-lock" and "twist-to-release" mechanism which facilitates simple and quick removal and/or inclusion of a cosmetic product applicator.

Embodiments may therefore provide a cosmetic container which includes a rotate-to-lock, rotate-to-release mechanism for enabling a user to connect or disconnect a cosmetic product applicator to/from the container.

The interlock arrangement may comprise a pair of opposing resilient latch members that are spaced apart so as to cooperate with opposing outer edges of a projection of an interface section of a cosmetic product applicator.

The interlock arrangement may comprise an aperture. The aperture may be shaped to only permit passage of a projection of an interface section through the aperture when the projection is oriented at a predetermined orientation with respect to the aperture.

The interlock arrangement may rotatable relative to the interface section of a cosmetic product applicator about an axis of rotation that is substantially parallel to the longitudinal axis of the tubular housing.

According to a second aspect of the invention, there is provided a cosmetic product applicator comprising an interface section adapted to releasably engage an interlock arrangement of a cosmetic container according to a first aspect of the invention.

The interface section may comprise a projection having a circumferential flange, and wherein the projection has a cross-sectional shape having a longitudinal extent greater than a lateral extent.

According to a third aspect of the invention, there is provided a cosmetic container for housing a cosmetic product applicator comprising: a tubular housing within which a cosmetic product applicator can be inserted; and a platform positioned within the tubular housing, the platform being movable along the longitudinal axis of the housing, wherein the platform comprises an interlock arrangement adapted to releasably engage an interface section of a cosmetic product applicator, and wherein the interlock arrangement is adapted to deform the interface section of a cosmetic product applicator so as to move the interface section between a locked configuration, in which the cosmetic product applicator is secured to the platform to prevent its removal from the cosmetic container, and a release configuration, in which the cosmetic product applicator is releasable from the platform so as to permit its removal from the cosmetic container.

The interlock arrangement may comprise an aperture, the aperture being adapted to only permit passage of a projection of an interface section through the aperture when the interface section is in the release configuration. Also, the tubular housing and the interlock arrangement may be adapted to cooperate to deform interface section of a cosmetic product applicator in a direction that is substantially perpendicular to the longitudinal axis of the tubular housing. Embodiments may therefore employ a "push-to-lock" and "push-to-release" mechanism which facilitates simple and quick removal and/or inclusion of a cosmetic product applicator.

The interface section of a cosmetic product applicator may be deformed so as to move between the locked configuration and the release configuration by movement of at least part of the tubular housing relative to the platform along the longitudinal axis of the housing. Further, the tubular housing may comprise first and second portions, and the interface section of a cosmetic product applicator may be deformed so as to move between the locked configuration and the release configuration by movement of the first portion of the tubular housing relative to the second portion of the tubular housing along the longitudinal axis of the housing.

Embodiments may therefore provide a cosmetic container which includes a push-to-lock, push(or squeeze)-to-release mechanism for enabling a user to connect or disconnect a cosmetic product applicator to/from the container.

In an alternative embodiment, the tubular housing may comprise a rigid member movable along the longitudinal axis of the housing, and the interface section of a cosmetic product applicator may deformed so as to move between the locked configuration and the release configuration by movement of the rigid member relative to the platform along the longitudinal axis of the housing. Embodiments may therefore provide a plunger or button which acts to deform the interface section of a cosmetic product applicator so as to move it to the release configuration when the plunger or button is pressed by a user. In other words, there may be provided a push-button release mechanism for enabling a user to disconnect a cosmetic product applicator from the container.

The platform may be movable along the longitudinal axis of the housing between a retracted position, in which the platform is situated near one end of the housing, and an extended position, in which the platform is situated near the other end of the housing.

According to a fourth aspect of the invention, there is provided a cosmetic product applicator comprising an interface section adapted to releasably engage an interlock arrangement of a cosmetic container according to a third aspect of the invention.

The interface section may be adapted to be deformable so as to move between a locked configuration, in which the cosmetic product applicator is secured to the platform to prevent its removal from the cosmetic container, and a release configuration, in which the cosmetic product applicator is releasable from the platform so as to permit its removal from the cosmetic container.

In an embodiment, the interface section may comprise a deformable latch member adapted to cooperate with the interlock arrangement so as to secure the cosmetic product applicator to the platform when in the locked configuration. Further, the interface section may comprise at least one projection having a flange.

The interface section may be deformable relative to the interlock arrangement in a direction that is substantially perpendicular to the longitudinal axis of the tubular housing.

In an embodiment, the platform may be movable along the longitudinal axis of the housing between a retracted position, in which the platform is situated near one end of the housing, and an extended position, in which the platform is situated near the other end of the housing Embodiments thus provide a simple and reliable container for a cosmetic product, the container including a tubular housing into which a cosmetic product applicator can be inserted and releasably connected to a platform of the container. The cosmetic product applicator may therefore be unconnected from the platform and removed from the container so as to be replaced with a different cosmetic product applicator. Such embodiments therefore provide for the container to be re-filled with a new cosmetic product applicator (after the former cosmetic product applicator has been exhausted, for example). Embodiments may therefore provide a re-fillable cosmetic container and a cosmetic applicator re-fill for the container.

Embodiments reduce the risk of unintentional removal of a cosmetic product applicator, provide original and refined aesthetics, and do not result in an unacceptable overall size.

Also, embodiments provide a container which may offer greater satisfaction and pleasure to a consumer, thereby enhancing the appeal and marketability of the cosmetic product is contains.

With a cosmetic product applicator being releasably attachable to a platform, embodiments may cater for replacement of the cosmetic product applicator, thus enabling a user a lower cost option than replacing the entire container for example. Such embodiments may therefore make it economically viable for a manufacturer to create a more prestigious, substantial and/or and elegant tubular housing which can be re-used with different cosmetic product applicators.

The cosmetic product applicator may be provided in stick form and the cosmetic product may be any facial or bodily cosmetic or beauty treatment product including lipstick, lip-gloss, eye-brow, eye-shadow, concealer, blusher, foundation, skin-treatment and the like.

An embodiment of a cosmetic product applicator may comprise a removable tubular housing adapted to cover a stick of cosmetic product and to be removably connected to the interface section. The tubular housing may further comprise a removal interface having at least one latching surface adapted to engage cosmetic product applicator to facilitate its removal from a cosmetic container.

BRIEF DESCRIPTION OF THE DRAWINGS

An example of the invention will now be described with reference to the accompanying diagrams, in which.

DETAILED DESCRIPTION

Figure 1:
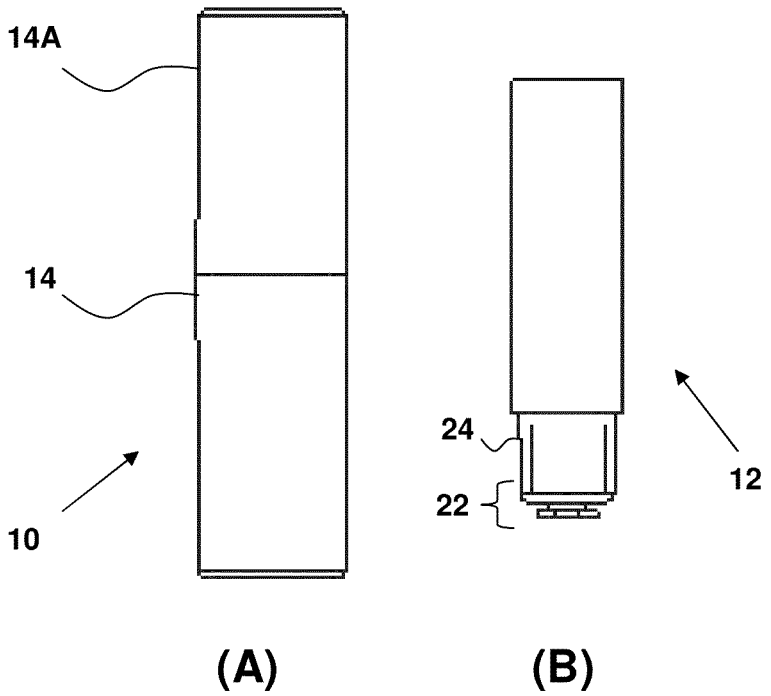
FIG. 1 is a side view of a lipstick container (FIG. 1A) and a lipstick applicator (FIG. 1B) according to an embodiment of the invention.

Referring to FIG. 1A, there is shown a lipstick container 10 according to an embodiment of the invention. FIG. 1B shows a lipstick applicator 12 according to an embodiment of the invention. The lipstick container 10 comprises a tubular housing 14 (of circular section) within which the lipstick applicator 12 can be inserted when the lid section 14A of the tubular housing has been removed.

Figure 3:
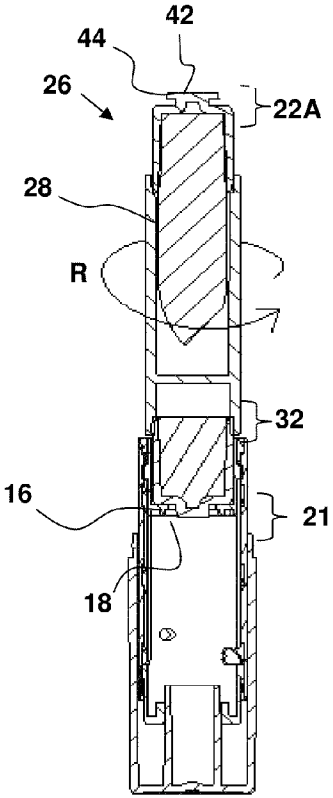
FIG. 3 shows a modification to the arrangement of FIG. 2 wherein the lipstick applicator is engaged with the depleted lipstick applicator and being rotated from a locked configuration to a release configuration.
Figure 2:
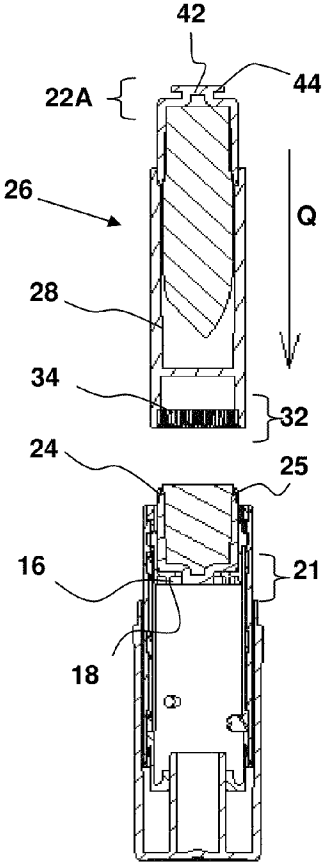
FIG. 2 is a cross-sectional view of the lipstick container and lipstick applicator of FIG. 1, wherein the lid section of the lipstick container has been removed, and wherein the lipstick container contains a depleted lipstick applicator according to an embodiment of the invention.

Turning now to FIGS. 2-3, the lipstick container 10 comprises a platform 16 slidably mounted within the tubular housing 14.

The platform 16 comprises a flat bottom portion 18 having an aperture 20 formed therethrough (and positioned at the centre of the bottom portion 18).

The aperture 20 forms part of an interlock arrangement 21 of the platform 16. The interlock arrangement is adapted to releasably engage an interface section 22 of a lipstick applicator. Here, FIG. 2 illustrates an interface section 22 of a lipstick applicator 12, wherein the lipstick has been depleted (i.e. used up) so that the only lipstick that remains is recessed within a cup-shaped lipstick holder 24 connected to the interface section 22.

The platform 16 has been moved along the longitudinal axis of the housing from a retracted position, in which the platform 16 is situated in proximity to the closed end of the housing 14 (and the cup-shaped lipstick holder 24 is fully retracted within the tubular housing 14), to an extended position, in which the platform 16 is situated in proximity to the open end of the housing 14 (and a top portion of the cup-shaped lipstick holder 24 projects from the open end of the housing 14 to expose a latching surface 25).

A further lipstick applicator 26 according to the invention comprises a removable tubular housing 28 adapted to cover a stick of lipstick product 30, wherein the tubular housing is removable from the interface section 22A of the further lipstick applicator 26. Here, the tubular housing 28 comprises a removal interface 32 having a latching surface 34 (formed with a plurality of grooves) that is adapted to engage an exposed latching surface 25 of the depleted lipstick applicator 12 held by the lipstick container 10. The latching surface 25 of the depleted lipstick applicator 12 is formed with a plurality of grooves that are adapted to have a complimentary fit with the grooves of the latching surface 34 of the removal interface 32 (of the further lipstick applicator's 26 tubular housing 28). Thus, the removal interface 32 of the further lipstick applicator 26 may be moved to engage the depleted lipstick applicator 12 (as depicted by the downward pointing arrow labelled "Q" in FIG. 2).

It will therefore be appreciated that the removal interface 12 may be mated with the exposed latching surface 25 of the depleted lipstick applicator 12. Such engagement of the removal interface with the depleted lipstick applicator 12 is illustrated in FIG. 3. When mated as shown in FIG. 3, rotation of the tubular housing 28 of the further lipstick applicator 26 (as indicated by the arrow labelled "R") causes equal rotation of the depleted lipstick applicator 12, because the removal interface 32 of the further lipstick applicator 26 is coupled to the depleted lipstick applicator 12 to prevent rotation of the depleted lipstick applicator 12 relative to the tubular housing 28 of the further lipstick applicator 26. In this way, the further lipstick applicator 26 may be used to rotate the depleted lipstick applicator 12 (about the longitudinal axis of the lipstick container 10) from a locked configuration, in which the lipstick applicator 12 is secured to the platform 16 to prevent its removal from the lipstick container 10, to a release configuration, in which the lipstick applicator 12 is releasable from the platform 16 so as to permit its removal from the lipstick container 10.

Figure 5:
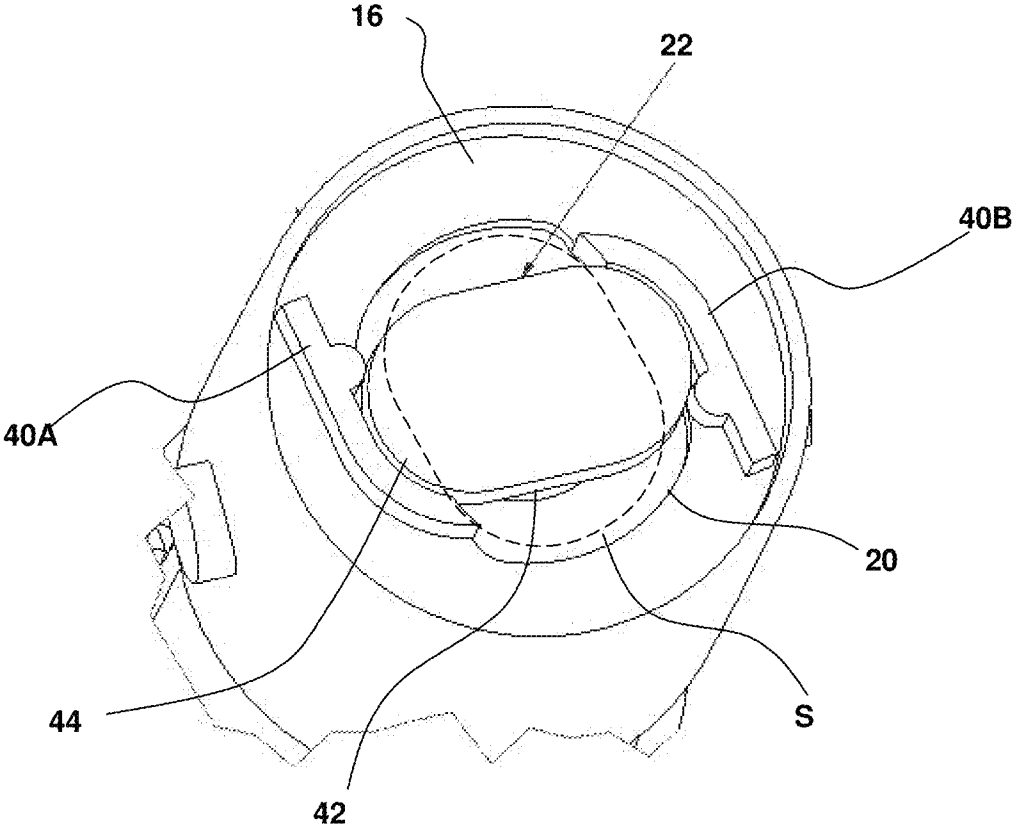
FIG. 5 depicts the coupling of the interface section and interface assembly of the lipstick container and lipstick applicator of FIG. 1.

In this embodiment, rotation of the depleted lipstick applicator 12 causes corresponding rotation of its interface section 22 so as to move the interface section between a locked configuration and a release configuration. Referring to FIG. 5, there is shown an close-up view of the interface section 22 of the depleted lipstick applicator 12 of FIG. 3, wherein the interface section 22 is coupled to the interlock arrangement 21 of the platform 16. Here, the interlock arrangement 21 comprises an aperture 20 and a pair of opposing resilient latch members 40A and 40B that are spaced apart on either side of the apertures 20 periphery. The latch members 40A and 40B are arranged to cooperate with opposing outer edges of the interface section 22 of the lipstick applicator 22. In the illustrated embodiment, the interface section 22 comprises a projection 42 with a flange 44 around its periphery. Both the aperture 20 and the flange 44 are formed with an elongated shape that is closely matched. Also, the flange 44 is marginally smaller than the aperture 20 so that the flange 44 can pass through the aperture when oriented in the same orientation.

In the locked configuration, the resilient latch members 40A and 40B contact opposing edges of the flange 44, and the longitudinal axis of the flange 44 is substantially perpendicular to the longitudinal axis of the aperture. This arrangement prevents the flange 44 from passing through the aperture 20. It is also restricts rotation (i.e. provides a level of resistance against rotation) of the flange 44 about the longitudinal axis of the lipstick container 10. The interface section 22 of lipstick applicator 12 is thus secured to interface assembly 21 of the platform 16 in the locked configuration. Movement of the platform up and down the longitudinal axis of the tubular housing 14 of the lipstick container 10 will consequently result in corresponding movement of the lipstick applicator 12 up and down the tubular housing 14. With the interface section 22 and the interlock arrangement 21 in the locked configuration, the lipstick applicator 12 can be moved between a retracted position (wherein the lipstick applicator 12 is retracted within the tubular housing 14 to prevent the lipstick from protruding from the open end of the housing 14) and an extended position (wherein the lipstick applicator 12 is near the open end of the tubular housing 14 so that lipstick protrudes from the open end of the housing 14).

As will be appreciated from FIG. 5, when in the locked configuration, rotation of the interface section 22 about the longitudinal axis of the tubular housing 14 by approximately 90° (ninety degrees) (i.e. a quarter of a turn) relative to the interlock arrangement 21 moves the interface section 22 to a release configuration (as illustrated by the dashed lined labelled "S" in FIG. 5). Such rotation can be affected by applying a rotational force which overcomes the resistance against rotation provided by the resilient latch members 40A and 40B.

In the release configuration, the resilient latch members 40A and 40B are spaced apart from (i.e. do not contact) opposing edges of the flange 44, and the longitudinal axis of the flange 44 is substantially parallel to the longitudinal axis of the aperture 20. This arrangement enables the flange 44 to pass through the aperture 20. The interface section 22 of lipstick applicator 12 is thus released from interlock arrangement 21 of the platform 16 in the release configuration, and the lipstick applicator 12 can be removed from the platform 16 by pulling the flange 44 through the aperture (along the longitudinal axis of the tubular housing 14 of the lipstick container 10). In other words, removal of the lipstick applicator 12 from the platform of the lipstick container 10 is enabled in the release configuration.

Figure 4:
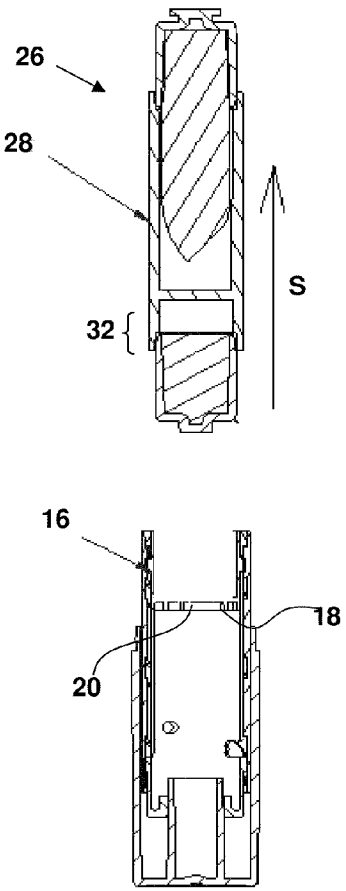
FIG. 4 shows a modification to the arrangement of FIG. 3 wherein the depleted lipstick applicator has been removed from the lipstick container using the lipstick applicator according to an embodiment of the invention.

Referring back to FIG. 4, with the depleted lipstick applicator 12 having been rotated to the release configuration (by rotation of the engaged further lipstick applicator 26 as shown by the arrow labelled "R" in FIG. 3), the depleted lipstick applicator 14 can be removed by pulling the further lipstick applicator away from the platform 16 in a direction along the longitudinal axis of the lipstick container 10 (as shown by the arrow labelled "T" in FIG. 4).

Figure 6:
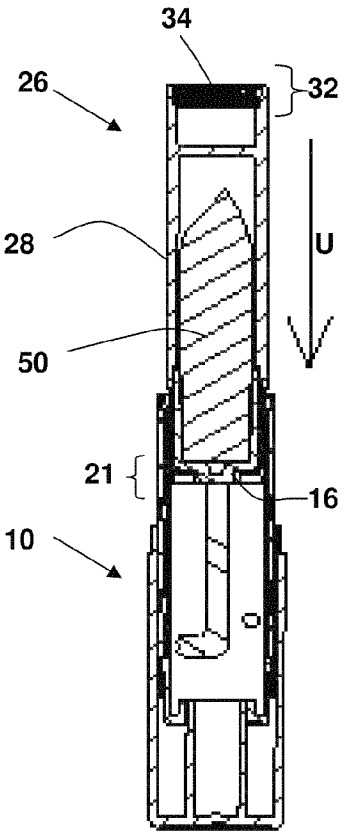
FIG. 6 shows a modification to the arrangement of FIG. 4 wherein the lipstick applicator is inserted into the lipstick container in a release configuration.
Figure 9:
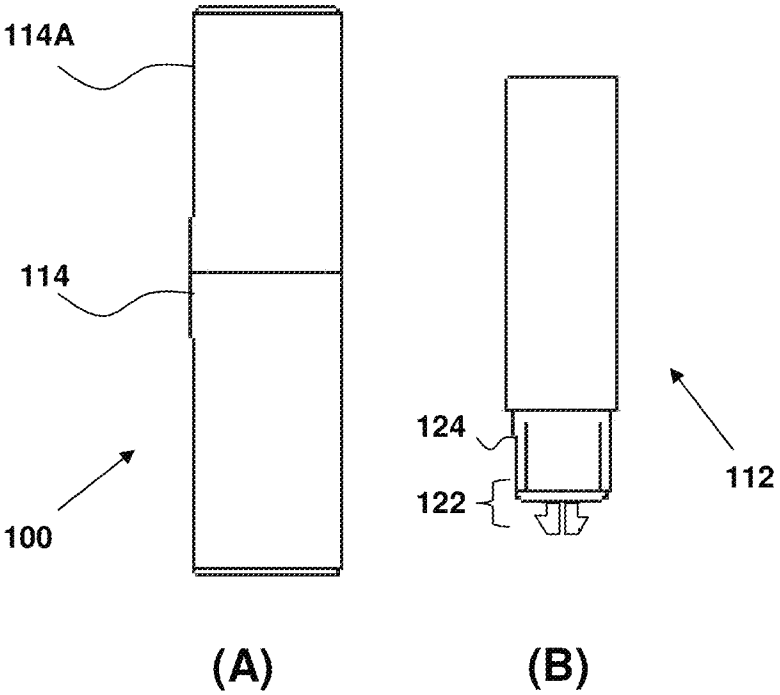
FIG. 9 is a side view of a lipstick container (FIG. 9A) and a lipstick applicator (FIG. 9B) according to an embodiment of the invention.

Next, as shown in FIG. 6, the further (replacement) lipstick applicator 26 can be inserted into the lipstick container 10 by pushing the new lipstick applicator 26 into the tubular housing 14 of the lipstick container 10 in a direction along the longitudinal axis of the lipstick container 10 (as shown by the arrow labelled "U" in FIG. 6), with the interface section 22 of the new lipstick applicator 26 oriented downwardly to face the platform 16.

The interface section 51 of the new lipstick applicator 50 is then coupled to interlock arrangement 21 of the platform 16. Here, the interface section 22A of the new lipstick applicator 26 is the same as the interface section 22 of the (previously removed) depleted lipstick applicator 12. Thus, the interface section 22A of the new lipstick applicator 26 comprises a projection 42 with a flange 44 around its periphery. The flange 44 is formed with an elongated shape that is closely matched to the elongate shape of the aperture 20 of the interlock arrangement 21. Also, the flange 44 is marginally smaller than the aperture 20 so that the flange 44 can pass through the aperture 20 when oriented in the same orientation.

Accordingly, the new lipstick applicator 26 is inserted into the tubular housing 14 of the lipstick container 10 with the rotational alignment of the flange 44 matching that of the aperture 20 (e.g. the longitudinal axis of the flange 44 is substantially parallel to the longitudinal axis of the aperture 20) so that the flange 44 of the interface section 22A passes through the aperture 20 of the interlock arrangement 21. The new lipstick applicator is thus connected to the platform 16 of the lipstick container in the release configuration.

Figure 7:
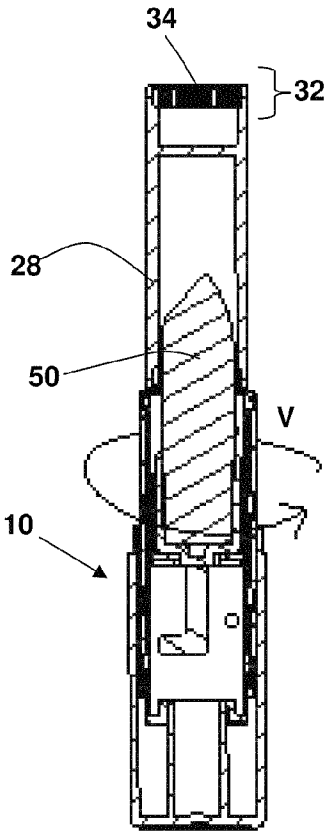
FIG. 7 shows a modification to the arrangement of FIG. 6 wherein the lipstick applicator is engaged with platform of the lipstick container and being rotated from a release configuration to a locked configuration.

As shown in FIG. 7, the new lipstick applicator 26 is then rotated 90° (i.e. a quarter of a turn) from the release configuration to the locked configuration (as shown by the arrow labelled "V"). As a result, the resilient latch members 40A and 40B contact opposing edges of the flange 44, and the longitudinal axis of the flange 44 is substantially perpendicular to the longitudinal axis of the aperture 20. As has been explained above in conjunction with FIG. 5, this arrangement prevents the flange 44 from passing through the aperture 20. It is also restricts rotation (i.e. provides a level of resistance against rotation) of the flange 44 about the longitudinal axis of the lipstick container 10. The interface section 22A of further lipstick applicator 26 is thus secured to interface assembly 21 of the platform 16 in the locked configuration. Subsequent movement of the platform 16 up and down the longitudinal axis of the tubular housing 14 of the lipstick container 10 will consequently result in corresponding movement of the new lipstick applicator 12 up and down the tubular housing 14.

Figure 8:
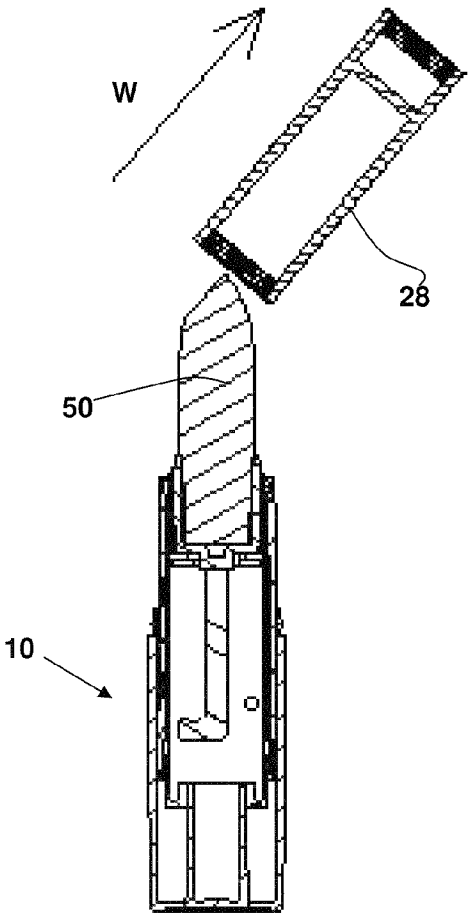
FIG. 8 shows a modification to the arrangement of FIG. 7 wherein a cover of the lipstick applicator has been removed.

Finally, as shown in FIG. 8, the tubular housing 28 of the new lipstick applicator 26 can be removed from its interface section 22A (as indicated by the arrow labelled "W") to uncover the stick of lipstick 50.

The lipstick container described above (with reference to FIGS. 1-8) therefore includes an locking and unlocking mechanism which can described has a twist-to-lock, twist-to-unlock mechanism for enabling a user to add or remove a lipstick applicator to/from the container. The twist movement may be a rotation of half a turn or less (i.e. 180° or less) of the cosmetic applicator relative to the container.

By way of example, embodiments may be envisaged to employ a bayonet-like fitting wherein, to couple the cosmetic container to the cosmetic applicator, (male) pin(s) on the applicator are aligned with the (female) slot(s) on the container and the two components are pushed together. Once the pins reach the bottom of the slot, one or both parts are rotated so that the pin slides along a horizontal arm of the L-shape until it reaches the "serif". A resilient member then biases the male connector up into the "serif" to keep the pin locked into place. A user can connect such components quickly and, unlike screw connectors, they are not subject to cross-threading. To disconnect, the two parts are pushed together to move the pin out of the "serif" while twisting in the opposite direction than for connecting, and then pulling apart.

Referring now to FIGS. 9-12, there is depicted another embodiment of the invention.

FIG. 9A shows a lipstick container 100 according to an embodiment, and FIG. 9B shows a lipstick applicator 112 according to an embodiment. The lipstick container 100 comprises a tubular housing 114 (of circular section) within which the lipstick applicator 112 can be inserted when the lid section 114A of the tubular housing has been removed.

The lipstick container 100 comprises a platform 116 (not visible in FIGS. 9-10) slidably mounted within the tubular housing 114.

Figure 10B:
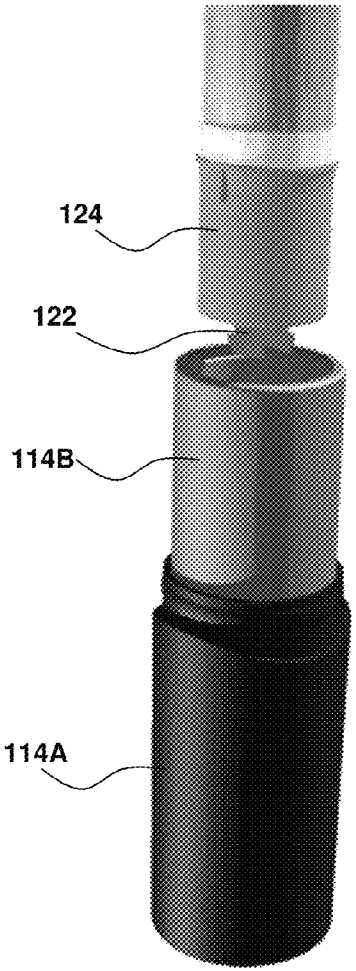
FIGS. 10A and 10B depict removal of a lipstick applicator from a lipstick container according to an embodiment of the invention.

The platform 116 forms part of an interlock arrangement adapted to releasably engage an interface section 122 of the lipstick applicator 112. Here, FIG. 10B illustrates an interface section 122 of a lipstick applicator 112, wherein the lipstick has been depleted (i.e. used up) so that the only lipstick that remains is held in a cup-shaped lipstick holder 124 connected to the interface section 122.

The platform 116 is movable along the longitudinal axis of the housing from a retracted position, in which the platform is situated in proximity to the closed end of the housing 114 (and the cup-shaped lipstick holder 124 is fully retracted within the tubular housing 114), to an extended position, in which the platform is situated in proximity to the open end of the housing 114 (and a top portion of lipstick projects from the open end of the housing 114 so as to be exposed).

The platform 116 comprises a flat bottom portion 118 having an aperture 120 formed therethrough (and positioned at the centre of the bottom portion 118).

The aperture 120 forms part of an interlock arrangement 121 of the platform 116. The interlock arrangement is adapted to releasably engage an interface section 122 of a lipstick applicator. The aperture 120 is adapted to only permit passage of a projection of an interface section 122 through the aperture 120 when the interface section 122 is in a release configuration.

Figure 10A:
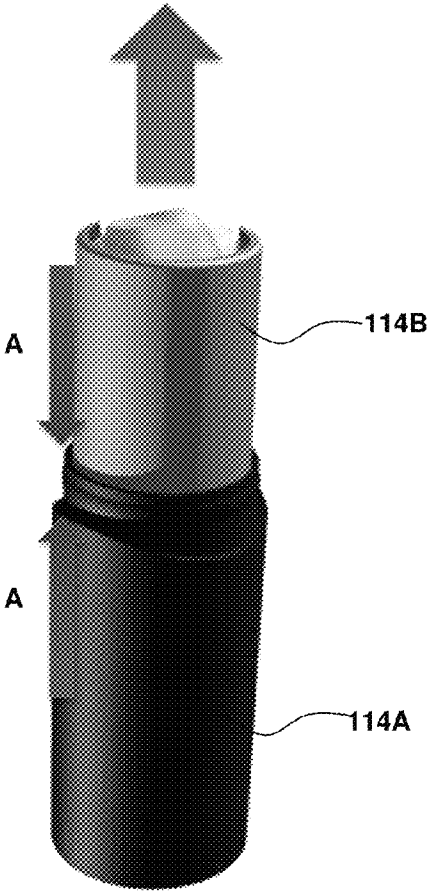
Figure 11:
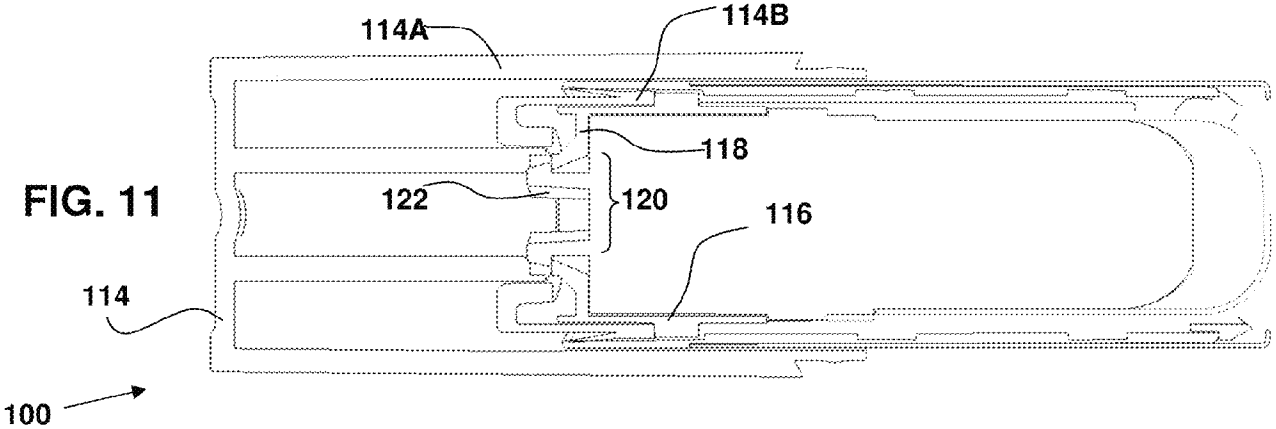
FIG. 11 is a cross-sectional view of the lipstick container and lipstick applicator of FIGS. 10A and 10B, wherein the lipstick applicator is engaged with a platform of the lipstick container and arranged in a locked configuration.
Figure 12:
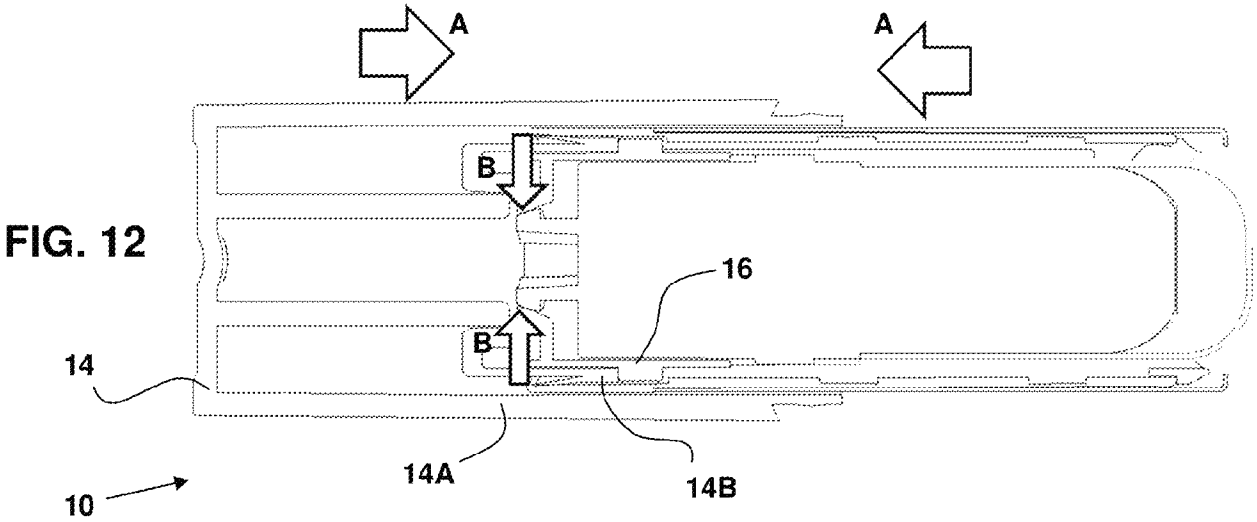
FIG. 12 is a cross-sectional view of the lipstick container and lipstick applicator of FIGS. 10A and 10B, wherein the lipstick applicator is moved to a release configuration so as to permit its removal from the cosmetic container.

As depicted in FIG. 10A (by the arrows labelled "A"), first 14A and second 14B portions of the housing may be pressed together (in opposing directions along the longitudinal axis of the housing 114) to deform the interface section 122 of the lipstick applicator and move the interface section 122 from a locked configuration (depicted in FIG. 11) to a release configuration (depicted in FIG. 12) by movement of the first portion of the tubular housing relative to the second portion of the tubular housing along the longitudinal axis of the housing.

In this way, movement of the first portion 114A of the tubular housing relative to the second portion 114B of the tubular housing along the longitudinal axis of the housing 114 (e.g. by pressing the first 114A and second 114B portions towards each other) may be used to moved the depleted lipstick applicator 112 from a locked configuration (depicted in FIG. 11), in which the lipstick applicator 112 is secured to the platform to prevent its removal from the lipstick container 100, to a release configuration (depicted in FIG. 12), in which the lipstick applicator 112 is releasable from the platform so as to permit its removal from the lipstick container 100 (as depicted in FIG. 10B).

In this embodiment, movement of the first portion 114A of the tubular housing relative to the second portion 114B of the tubular housing along the longitudinal axis of the housing 114 results in deformation of the interface section 122 (as depicted by arrows labelled "B" in FIG. 12) in a direction perpendicular to the longitudinal axis of the housing which moves the interface section between the locked configuration and the release configuration.

Figure 13:
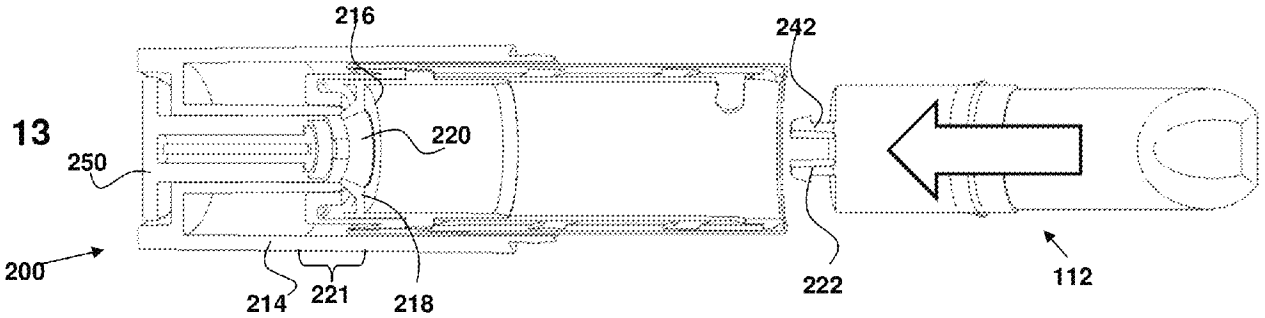
FIG. 13 is a cross-sectional view a lipstick container and a lipstick applicator according to an embodiment of the invention, wherein the lipstick applicator is depicted prior to being inserted into the lipstick container.
Figure 14:
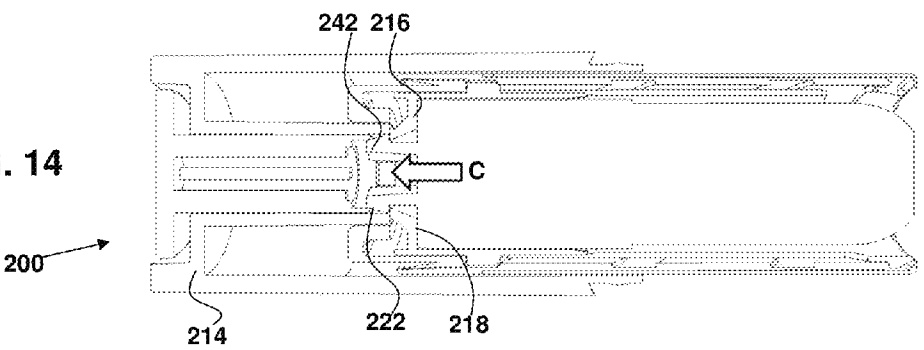
FIG. 14 shows a modification to the arrangement of FIG. 13 wherein the lipstick applicator is inserted into the lipstick container and engaged with a platform of the lipstick container in a locked configuration.
Figure 15:
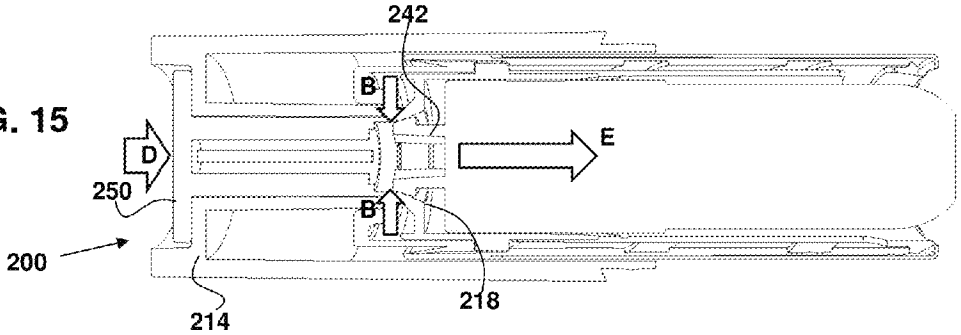
FIG. 15 shows a modification to the arrangement of FIG. 14 wherein the lipstick applicator is moved to a release configuration by movement of a plunger in a direction parallel to the longitudinal axis of the lipstick container.

Turning now to FIGS. 13-15, there is shown a lipstick container 200 according to another embodiment of the invention. The lipstick container 200 comprises a platform 216 slidably mounted within a tubular housing 214.

The platform 216 comprises a flat bottom portion 218 having an aperture 220 formed therethrough (and positioned at the centre of the bottom portion 218).

The aperture 220 forms part of an interlock arrangement 221 of the platform 216. The interlock arrangement is adapted to releasably engage an interface section 222 of a lipstick applicator. Here, FIG. 13 illustrates an interface section 222 of a lipstick applicator 112, wherein the lipstick applicator 112 is separated from the platform 216 (prior to engagement with platform 216, for example).

In FIG. 13, the platform 216 has been moved along the longitudinal axis of the housing from a retracted position, in which the platform 216 is situated in proximity to the closed end of the housing 214, to an extended position, in which the platform 216 is situated in proximity to the open end of the housing 214.

In the illustrated embodiment, the interface section 222 comprises a pair of deformable latch members 242.

Next, as shown in FIG. 14, the lipstick applicator 112 can be inserted into the lipstick container 200 by pushing the lipstick applicator 112 into the tubular housing 214 of the lipstick container 200 in a direction along the longitudinal axis of the lipstick container 200 (as shown by the arrow labelled "C" in FIG. 14), with the interface section 222 of the lipstick applicator 112 oriented to face the platform 216.

The deformable latch members 242 are pushed through the aperture 220 so as to couple the interface section 222 of the applicator 112 to the interlock arrangement 221 of the platform 216. Accordingly, the lipstick applicator 112 is inserted into the tubular housing 214 of the lipstick container 200 with the alignment of the deformable latch members 242 matching the aperture 220 so that the deformable latch members 242 of the interface section 222 pass through the aperture 220 of the interlock arrangement 221. The lipstick applicator 112 is thus connected to the platform 216 in the locked configuration.

The interface section 222 of the lipstick applicator 112 is thus secured to interlock arrangement 221 in the locked configuration. Subsequent movement of the platform 216 up and down the longitudinal axis of the tubular housing 214 of the lipstick container 200 will consequently result in corresponding movement of the lipstick applicator 112 up and down the tubular housing 214.

As shown in FIG. 15, the platform 216 is moved along the longitudinal axis of the housing from the extended position to the retracted position.

The lipstick applicator 112 may then be released from the platform 216 (e.g. after being depleted of cosmetic product) by moving a rigid member 250 along the longitudinal axis of the housing 214 so that it contacts the deformable latch members 242 of the interface section 222. Further movement of the rigid member 250 along the longitudinal axis of the housing 214 (as illustrated by the arrow labelled "D" in FIG. 15) causes the deformable latch members 242 to deform so as to move from the locked configuration to the release configuration. As a result, the resilient latch members 242 are deformed (as depicted by arrows labelled "B" in FIG. 15) towards each other (e.g. inwardly towards the longitudinal central axis of the housing 214) so that they can pass through the aperture 220. This permits the interface section 222 of the lipstick applicator 112 to pass through the aperture 220 so that the lipstick applicator 112 can be removed from housing 214 (as depicted by arrow labelled "E" in FIG. 15).

The lipstick container described above (with reference to FIGS. 13-15) therefore includes an locking and unlocking mechanism which can described has a push-to-lock, push-to-unlock mechanism for enabling a user to add or remove a lipstick applicator to/from the container. The push movement may be a pressing movement of a button that causes movement of the rigid member 250 along the longitudinal axis of the housing 214.

By way of example, embodiments may be envisaged to employ a snap-like fitting wherein, to couple the cosmetic container to the cosmetic applicator, a (male) latch on the applicator is aligned with the (female) aperture on the container and the two components are pushed together. Once the latch passes through the aperture, the latch seats against the edge of the aperture to hold the latch in place. A user can connect such components quickly and, unlike screw connectors, they are not subject to cross-threading. To disconnect, two parts are pushed together to deform the latch and pass it back out through the aperture, and then pulling apart.

While specific embodiments have been described herein for purposes of illustration, various modifications will be apparent to a person skilled in the art and may be made without departing from the scope of the invention.

For example, although the embodiments described above contain lipstick, it will be appreciated that other embodiments may be used to contain a cosmetic product applicator for other types of cosmetic products (such as lip-gloss, foundation, eye shadow, mascara or blusher for example).

Also, although the embodiments have been described having tubular housing with a circular or rectangular cross-sectional shape, other embodiments may comprise tubular housing having a different cross-sectional shape (such a regular or irregular polygonal shape).

The invention claimed is:

1. A cosmetic container for housing a cosmetic product applicator comprising:

a tubular housing within which a cosmetic product applicator can be inserted; and a platform positioned within the tubular housing, the platform being movable along the longitudinal axis of the housing, wherein the platform comprises an interlock arrangement adapted to releasably engage an interface section of a cosmetic product applicator, and wherein the interlock arrangement is adapted to deform the interface section of a cosmetic product applicator so as to move the interface section between a locked configuration, in which the cosmetic product applicator is secured to the platform to prevent its removal from the cosmetic container, and a release configuration, in which the cosmetic product applicator is releasable from the platform so as to permit its removal from the cosmetic container, wherein the tubular housing and the interlock arrangement are adapted to cooperate to deform an interface section of a cosmetic product applicator in a direction that is substantially perpendicular to the longitudinal axis of the tubular housing, wherein the interface section of a cosmetic product applicator is adapted to be deformed so as to move between the locked configuration and the release configuration by movement of at least part of the tubular housing relative to the platform along the longitudinal axis of the housing, wherein the tubular housing comprises first and second portions, and wherein the interface section of a cosmetic product applicator is adapted to be deformed so as to move between the locked configuration and the release configuration by movement of the first portion of the tubular housing relative to the second portion of the tubular housing along the longitudinal axis of the housing.

2. The cosmetic container of claim 1, wherein the interlock arrangement comprises an aperture, the aperture being adapted to only permit passage of a projection of an interface section through the aperture when the interface section is in the release configuration.

3. The cosmetic container of claim 1, wherein the platform is movable along the longitudinal axis of the housing between a retracted position, in which the platform is situated in proximity to one end of the housing, and an extended position, in which the platform is situated in proximity to the other end of the housing.

4. A cosmetic container for housing a cosmetic product applicator comprising:

a tubular housing within which a cosmetic product applicator can be inserted; and a platform positioned within the tubular housing, the platform being movable along the longitudinal axis of the housing, wherein the platform comprises an interlock arrangement adapted to releasably engage an interface section of a cosmetic product applicator, and wherein the interlock arrangement is adapted to deform the interface section of a cosmetic product applicator so as to move the interface section between a locked configuration, in which the cosmetic product applicator is secured to the platform to prevent its removal from the cosmetic container, and a release configuration, in which the cosmetic product applicator is releasable from the platform so as to permit its removal from the cosmetic container, wherein the tubular housing and the interlock arrangement are adapted to cooperate to deform an interface section of a cosmetic product applicator in a direction that is substantially perpendicular to the longitudinal axis of the tubular housing, wherein the interface section of a cosmetic product applicator is adapted to be deformed so as to move between the locked configuration and the release configuration by movement of at least part of the tubular housing relative to the platform along the longitudinal axis of the housing, wherein the tubular housing comprises a rigid member movable along the longitudinal axis of the housing, and wherein the interface section of a cosmetic product applicator is adapted to be deformed so as to move between the locked configuration and the release configuration by movement of the rigid member relative to the platform along the longitudinal axis of the housing.

5. A cosmetic product applicator having an interface section adapted to releasably engage an interlock arrangement of a platform of a cosmetic container wherein the interface section is adapted to be rotatable relative to the interlock arrangement of the cosmetic container to move between a locked configuration, in which the cosmetic product applicator is secured to the platform to prevent its removal from the cosmetic container, and a release configuration, in which the cosmetic product applicator is releasable from the platform so as to permit its removal from the cosmetic container and wherein the interface section is adapted to support a stick of cosmetic product, the cosmetic product applicator comprising:

a removable tubular housing adapted at one end to be removably connected to the interface section so as to cover the stick of cosmetic product, wherein the removable tubular housing comprises, at the other end of the removable tubular housing, a removal interface comprising at least one latching surface adapted to engage a further cosmetic product applicator to facilitate removal of the further cosmetic product applicator from a cosmetic container.

6. The cosmetic product applicator of claim 5, wherein the interface section comprises a projection having a circumferential flange, and wherein the projection has a cross-sectional shape having a longitudinal extent greater than a lateral extent.

7. The cosmetic product applicator according to claim 5, wherein the cosmetic product is lipstick, lip-gloss, foundation, mascara, blusher or eyeshadow.

8. The cosmetic product applicator according to claim 5, wherein the cosmetic product applicator comprises a stick of cosmetic product.

* * * * *